US011739495B2

(12) United States Patent
Cui et al.

(10) Patent No.: US 11,739,495 B2
(45) Date of Patent: Aug. 29, 2023

(54) REINFORCING AND LIFTING METHOD AND REINFORCING AND LIFTING STRUCTURE FOR LARGE-SCALE PIERS OF HIGH-SPEED RAIL

(71) Applicant: BEIJING HENGXIANG HONGYE FOUNDATION REINFORCEMENT TECHNOLOGY CO., LTD., Beijing (CN)

(72) Inventors: Xuedong Cui, Beijing (CN); Jiguang Wu, Beijing (CN); Tengyue Cui, Beijing (CN)

(73) Assignee: BEIJING HENGXIANG HONGYE FOUNDATION REINFORCEMENT TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 17/588,208

(22) Filed: Jan. 28, 2022

(65) Prior Publication Data

US 2022/0154420 A1 May 19, 2022

Related U.S. Application Data

(63) Continuation of application No. PCT/CN2020/107625, filed on Aug. 7, 2020.

(30) Foreign Application Priority Data

Aug. 9, 2019 (CN) ..... 201910736193.X

(51) Int. Cl.
*E01D 19/02* (2006.01)
*E02D 3/12* (2006.01)
(Continued)

(52) U.S. Cl.
CPC ..... *E02D 35/005* (2013.01); *E01D 19/02* (2013.01); *E02D 3/12* (2013.01); *E02D 37/00* (2013.01)

(58) Field of Classification Search
CPC ..... E02D 35/005; E02D 19/02; E02D 3/12; E02D 37/00; E02D 35/00; E01C 23/10
See application file for complete search history.

(56) References Cited

U.S. PATENT DOCUMENTS 4,787,779 A * 11/1988 Clark ..... E02D 35/00 405/230
4,832,533 A * 5/1989 Ringesten ..... E02D 27/48 405/266
(Continued)

FOREIGN PATENT DOCUMENTS

CN 1749490 A 3/2006
CN 101487274 A 7/2009
(Continued)

OTHER PUBLICATIONS

International Search Report of PCT Patent Application No. PCT/CN2020/107625 dated Nov. 9, 2020.

*Primary Examiner* — Benjamin F Fiorello

(57) ABSTRACT

Disclosed are a reinforcing and lifting method and a reinforcing and lifting structure for large-scale piers of high-speed rail. The method comprises: obliquely drilling grouting holes for a pile shoe body downward around the bridge pier cap, the hole bottom goes deep into a pile foundation side position close to the bottom end of the bridge pier pile foundation, grouting the hole bottom, and reinforcing the soil body between a plurality of pile foundations and around the pile foundations to form the pile shoe body; vertically drilling holes downward around the bridge pier cap to form a plurality of curtain holes at intervals, and grouting the curtain holes to form an enclosed curtain wall, the curtain
(Continued)

wall and the pile shoe body form an inverted groove structure; obliquely drilling holes downward to form lifting holes, such that the bridge piers are gradually raised to a preset height.

9 Claims, 9 Drawing Sheets

(51) Int. Cl.
*E02D 35/00* (2006.01)
*E02D 37/00* (2006.01)

(56) References Cited

U.S. PATENT DOCUMENTS 4,906,140 A * 3/1990 Clark ..... E02D 35/00 405/230
9,328,474 B2 * 5/2016 Arya ..... E02D 5/18
10,961,682 B1 * 3/2021 Williams ..... E02D 3/12
2006/0013658 A1 * 1/2006 Erdemgil ..... E02D 27/34 405/266
2012/0163923 A1 * 6/2012 Erdemgil ..... E02D 27/02 405/259.1
2013/0129423 A1 * 5/2013 Hakkinen ..... E02D 27/34 405/128.7
2013/0333451 A1 * 12/2013 Yegian ..... C09K 17/00 405/128.7
2016/0362901 A1 * 12/2016 Tabatabai ..... E02D 3/12
2018/0016765 A1 * 1/2018 Baldwin ..... E02D 37/00
2018/0209113 A1 * 7/2018 Birtele ..... E02D 35/005
2019/0186095 A1 * 6/2019 Eddie ..... G01N 33/24

FOREIGN PATENT DOCUMENTS

CN 103306196 A 9/2013
CN 107100215 A 8/2017
CN 107476360 A 12/2017
CN 108343102 A 7/2018
CN 108457204 A 8/2018
CN 108547336 A 9/2018
CN 108842840 A 11/2018
CN 208501761 U 2/2019

* cited by examiner

REINFORCING AND LIFTING METHOD AND REINFORCING AND LIFTING STRUCTURE FOR LARGE-SCALE PIERS OF HIGH-SPEED RAIL

CROSS-REFERENCE TO RELATED APPLICATION

The present application is a continuation of international application of PCT application No. PCT/CN2020/107625 filed on Aug. 7, 2020, which claims the priority benefit of China application No. 201910736193.X filed on Aug. 9, 2019. The entirety of the above-mentioned patent applications is incorporated herein by reference and made a part of this specification.

TECHNICAL FIELD

The invention relates to the technical field of sedimentation treatment of large-scale piers of high-speed rail, and more particularly relates to a reinforcing and lifting method and a reinforcing and lifting structure for large-scale piers of high-speed rail.

BACKGROUND ART

Currently, with the development of China's economy, the construction of high-speed rail is also increasing. Compared with ordinary-speed rail, high-speed rail has higher requirements for track smoothness. However, currently, some of bridge piers of high-speed rail lines that have been in operation have settled, which has seriously affected the smoothness of the track and the comfort level of passengers, and therefore, the track needs to be raised and leveled. In the prior art, when the sedimentation amount is not large, grouting is generally performed between the whole track bed at the bottom of the track and a beam body; and when the sedimentation amount is relatively large, the method of lifting a bottom support of the beam body is used for adjustment. For example, the invention patent with the application number CN201310238096.0 discloses a bridge spiral support, and the track is lifted and leveled by adjusting the height of the support. However, with this patented technology, before the support is rotatably heightened, the beam body needs to be jacked up. When the beam body is a continuous beam, the beam body is heavy and cannot be jacked up with equipment. Therefore, it is necessary to develop a new lifting technology for the sedimentation of bridge piers of continuous beams (large piers are arranged at the bottoms of the continuous beams as supports, and are larger than those of ordinary span beam bodies).

SUMMARY

In view of the shortcomings of the prior art, the first objective of the invention is to provide a reinforcing and lifting method for large-scale piers of high-speed rail, which has the advantages that the large-scale piers that have settled can be lifted, and the lifted piers are not easy to settle again.

The above-mentioned objective of the invention is achieved through the following technical solution which comprises the following construction steps of:

step 1. forming a pile shoe body, obliquely drilling holes downward around a bridge pier cap to form a plurality of pile shoe body grouting holes, wherein the bottoms of the pile shoe body grouting holes go deep into side positions of pile foundations close to the bottom ends of the bridge pier pile foundations, pressure-grouting to the bottoms of the pile shoe body grouting holes, and reinforcing the soil body among the plurality of pile foundations and on the periphery of the pile foundations to form the pile shoe body; and step 2: reinforcing and lifting, obliquely drilling holes downward to form lifting holes, the lifting holes go deep into the bottoms of the pile foundations, pressure-grouting to the bottoms of the lifting holes, the injected grout is a rapid solidification grout, and as the grout between the pile shoe body and the interlayer of a bearing stratum of each pile bottom increases and solidifies rapidly, the bridge pier is gradually lifted to a preset height.

Through the above technical solution, the pile shoe body blocks channels through which the grout sprayed out from the bottoms of the lifting holes flows upward from the soil body among the pile foundations, and the grout can only flow or squeeze downward or horizontally. As the grout is a rapid solidification grout, the grout does not spread downward or horizontally without restrictions, but continuously solidifies between the pile shoe body and the interlayer of the bearing stratum of each pile bottom to form upward lifting force, and the bottoms of the pile foundations suffer the upward lifting force, so that the lifting of the large-scale piers is realized. Moreover, the pile shoe body reinforces the soil body around the bottoms of the pile foundations, and the pile shoe body and the pile foundations form a whole, which effectively avoids the offset of the bottoms of the pile foundations caused by the horizontal pressing force formed at the bottoms of the pile foundations during lifting and pressure grouting, and ensures the verticality of the pile foundations in the lifting process. In addition, as gaps in the soil body at the bottoms of the pile foundations are filled and compacted with grout, the secondary sedimentation of the lifted bridge pier is effectively avoided.

The invention is further configured to comprising the following steps of: grouting to form a curtain wall before the step of reinforcing and lifting, vertically drilling holes downward around the bridge pier cap to form a plurality of curtain holes at intervals, wherein the bottoms of the curtain holes go deep into positions below the bottom ends of the pile foundations; grouting the curtain holes, and the grouting ranges of the adjacent curtain holes mesh and overlap with each other to form an enclosed curtain wall; the top surface of the curtain wall is higher than the bottom surface of the pile shoe body; and in the step 2 of reinforcing and lifting, pressure grouting is performed at the bottoms of the lifting holes, and as the grout within the enclosed range of the curtain wall increases and solidifies rapidly, the bridge pier is gradually lifted to a preset height.

Through the above-mentioned technical solution, the curtain wall and the pile shoe body form an inverted groove structure, and then pressure grouting is performed at the bottoms of the piles; in the semi-closed structure formed by grooves, the grout injected in the range continuously solidifies and presses the surrounding soil body; and the grout does not spread due to the restriction of the curtain wall and the pile shoe body, and the direction of soil body extrusion is restricted by the surrounding curtain wall, so that the extrusion direction is mainly downward and upward. With the continuous injection of grout, the bottoms of the pile foundations suffer upward lifting force, so that the lifting of the large-scale pier is more efficient.

The present invention is further configured as follows: in the step 1, the bottoms of the pile shoe body grouting holes go deep into positions below the bottom ends of the bridge pier pile foundations, and after grouting, the gaps in the soil body below the bottom ends of the pile foundations are filled.

Through the above technical solution, during lifting and grouting, as the soil body between a grout outlet of a grouting pipe and the bottom end of each pile foundation has been filled and compacted, the lifting force can be transmitted more rapidly to the bottom ends of the pile foundations.

The invention is further configured as follows: the inner side surface, close to the top end, of the curtain wall abuts to the outer side surface of the pile shoe body.

Through the above technical solution, after abutment, the phenomenon of grout runout between the gaps of the curtain wall and the pile shoe body is avoided, and materials are saved.

The invention is further configured as follows: grouting the bottom of the cap so as to fill the gaps at the bottom of the cap after completing the step of reinforcing and lifting.

Through the above technical solution, after the pier is lifted, there are gaps between the bottom surface of the cap and the original soil, and after filling, the bottom surface of the cap can bear the force and bears the upper load together with the pile foundations.

The present invention is further configured as follows: part or all of the curtain holes are continuously grouted after lifting is completed, the grout is pressed into the soil body around the curtain holes to form the reinforced pile foundations, and the tops of the reinforced pile foundations extend to positions close to the bottom of the cap; the bottom of the cap is pressure-grouted to form a reinforced body, which extends out of the cap and is lapped on the top surface of the reinforced pile foundation.

Through the above technical solution, the reinforced body and the reinforced pile foundations form a new force-bearing system, which bears the upper load with the original pile foundations.

The present invention is further configured as follows: the curtain wall and the reinforced pile foundations are constructed by a drilling and grouting integrated machine, the grouting is performed sequentially in multiple sections in the vertical direction, and after the grout is sprayed out from the orifices of the grouting pipes, the grout is pressed into the surrounding soil body and solidifies within 30-60 s.

Through the above technical solution, grouting is performed in sections, and the grout sprayed out from each section rapidly solidifies, so that the interference to the original soil is reduced, and the accelerated sedimentation is avoided.

The present invention is further configured as follows: a plurality of horizontal grouting pipes are driven into the bottom of the cap horizontally, and grouting is performed to form a whole reinforced body at the bottom of the cap, and at the same time, the gaps at the bottom of the cap are filled.

Through the above technical solution, the horizontal grouting pipes can reinforce the soil body at the bottom of the cap center, so that the whole reinforced body with substantially the same thickness is formed at the bottom of the cap, and the upper load is better transferred to the reinforced pile foundations.

The invention is further configured as follows: during lifting and grouting, pressure grouting at the bottoms of all the pile foundations is performed simultaneously.

Through the above technical solution, the periphery of the pier can be lifted steadily, and thus, inclination is avoided.

The present invention is further configured as follows: the lifting holes are formed by the drilling and grouting integrated machine, and after the grout is sprayed out from the orifices of the grouting pipes, the grout is pressed into the surrounding soil body and solidifies within 5-30 seconds.

Through the above technical solution, the drilling and grouting integrated machine is convenient for construction and has high efficiency, and the rapidly solidified grout makes the lifting more efficient.

The second objective of the invention is to provide a reinforcing and lifting structure for the large-scale piers of high-speed rail, which has the advantages that the large-scale piers that have settled can be lifted, and the lifted piers are not easy to settle again.

In summary, the invention has the following beneficial effects:

1. pressure grouting is performed between the pile shoe body and the interlayer of each bearing stratum of the pile bottom, with the continuous injection of the grout, the bottoms of the pile foundations suffer the upward lifting force, and thus, the lifting of the large-scale pier is realized; in the lifting process, the pile shoe body ensures the verticality of the pile foundations; in addition, as the gaps in the soil body at the bottoms of the pile foundations are filled and compacted with the grout after lifting, the secondary sedimentation of the lifted bridge pier is effectively avoided;

2. pressure grouting is performed in the inverted groove formed by the curtain wall and the pile shoe body, so that the spreading of the grout is avoided, the upward lifting force is more concentrated, and the lifting effect is relatively good;

3. the reinforced pile foundations and the reinforced body form the new force-bearing system, which bears the load of the bridge pier together with the original cap and the pile foundations, and thus, the secondary sedimentation is avoided; and 4. the grout that can quickly solidify and the method of segmented grouting are used to minimize the softening of the original soil body in the construction process and avoid the accelerated sedimentation in the grouting process; in addition, the grout which solidifies rapidly in the groove has relatively good technical effects of squeezing the soil body and forming the lifting force.

DETAILED DESCRIPTION

Figure 1:
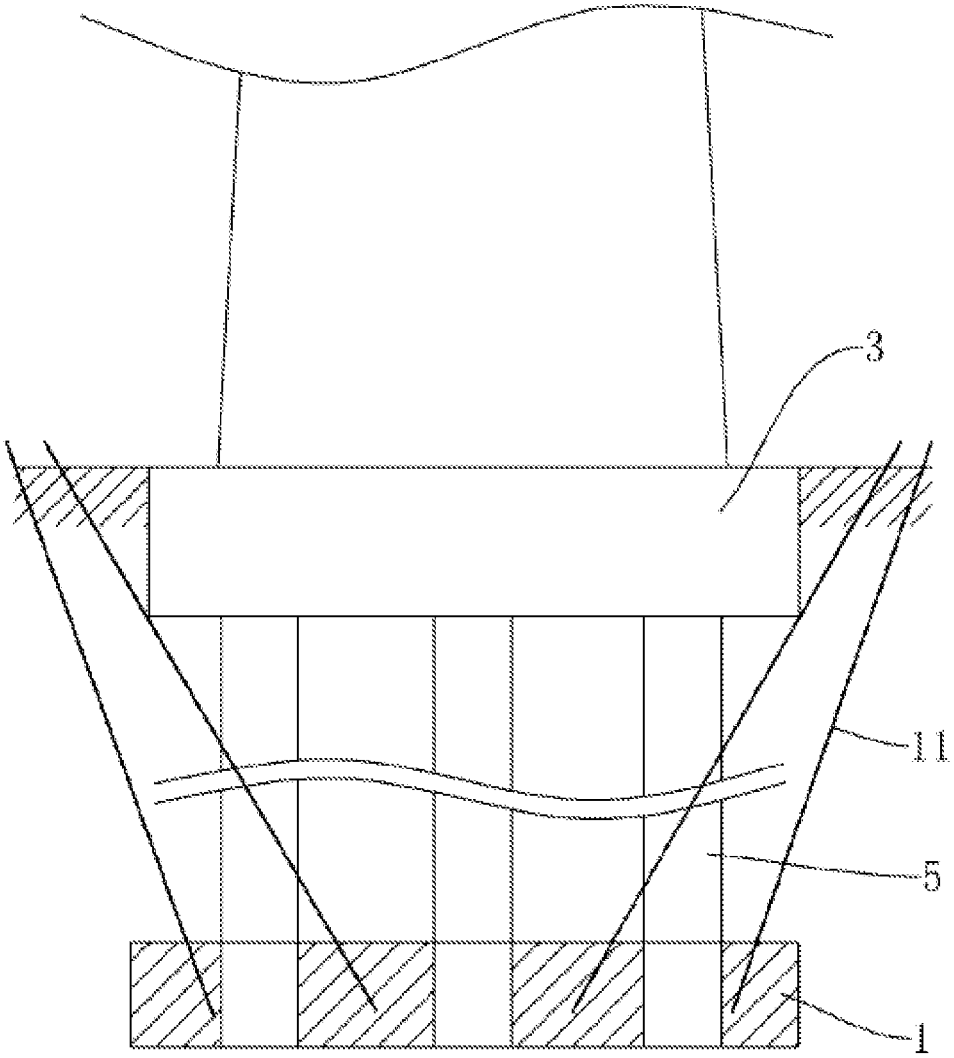
FIG. 1 is a schematic diagram of a pile shoe body formed in step 1.

The invention is further described below in detail with reference to the drawings. The same parts are indicated by the same reference numerals. It should be noted that the words "front", "rear", "left", "right", "upper", "lower", "bottom surface" and "top surface" used in the following description refer to the direction in the drawings, and the words "inner" and "outer" respectively refer to directions toward or away from the geometric center of a particular component.

Embodiment 1. A method for reinforcing and lifting large-scale piers of high-speed rail comprises the following construction steps of:

step 1. forming a pile shoe body 1, as shown in FIG. 1, obliquely drilling holes downward around a bridge pier cap 3 to form a plurality of grouting holes 11 for the pile shoe body, the bottoms of the grouting holes 11 for the pile shoe body go deep into side positions of pile foundations 5 close to the bottom ends of the bridge pier pile foundations 5, grouting the bottoms of the grouting holes 11 for the pile shoe body, and reinforcing the soil body among the plurality of pile foundations 5 and on the periphery of the pile foundations 5 to form the pile shoe body 1. A geological drilling rig can be used for drilling, and the diameters of drill holes can be 42 mm, and grouting pipes are inserted after drilling; and a drilling and grouting integrated machine can also be adopted, and after drilling, grouting is directly performed. The grouting pressure is determined according to the depth of the stratum, and can meet the requirement that the complete pile shoe body 1 is formed after the grouting ranges of the adjacent grouting holes 11 for the pile shoe body overlap.

Figure 2:
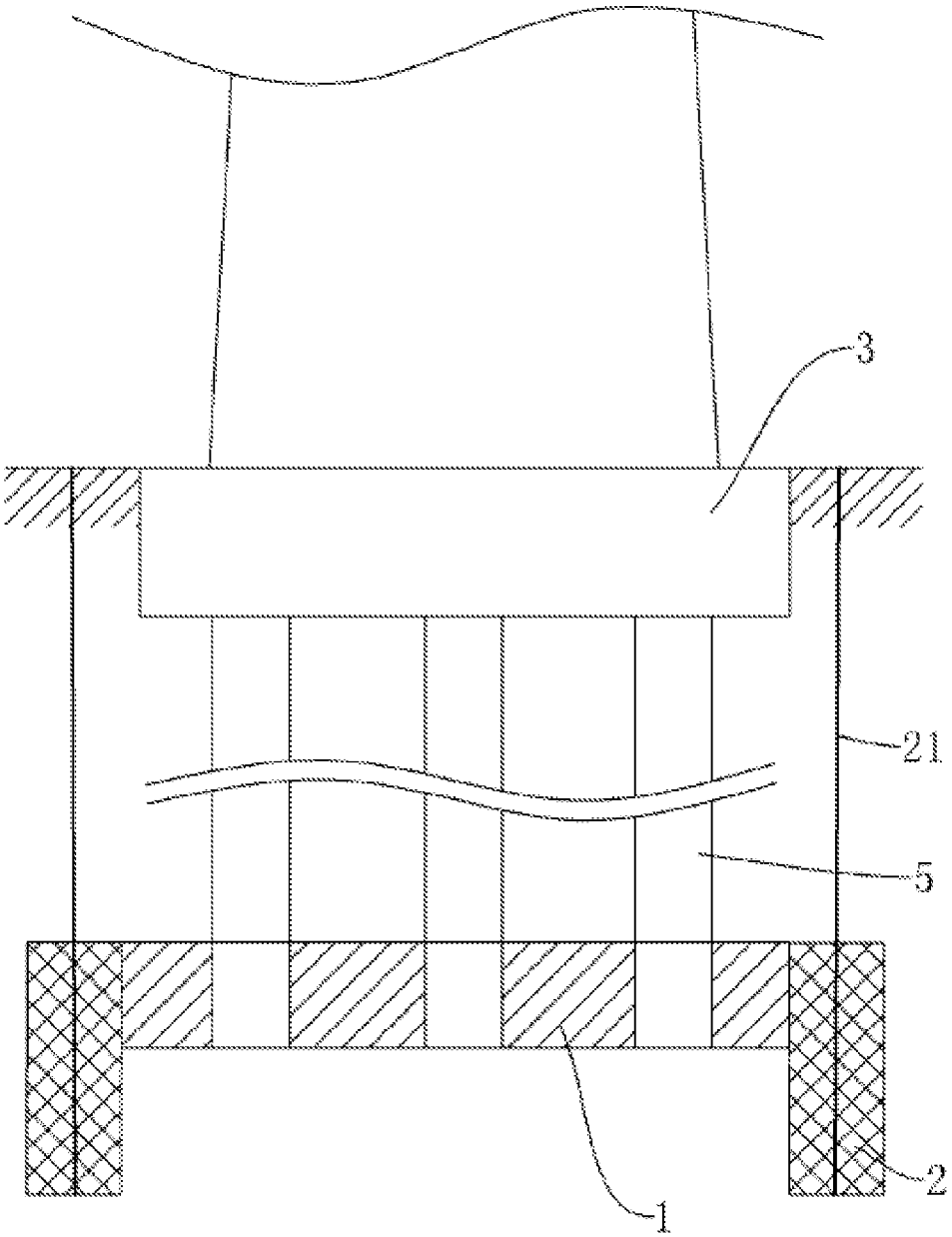
FIG. 2 is a schematic diagram of a curtain wall formed in step 2.
Figure 3:
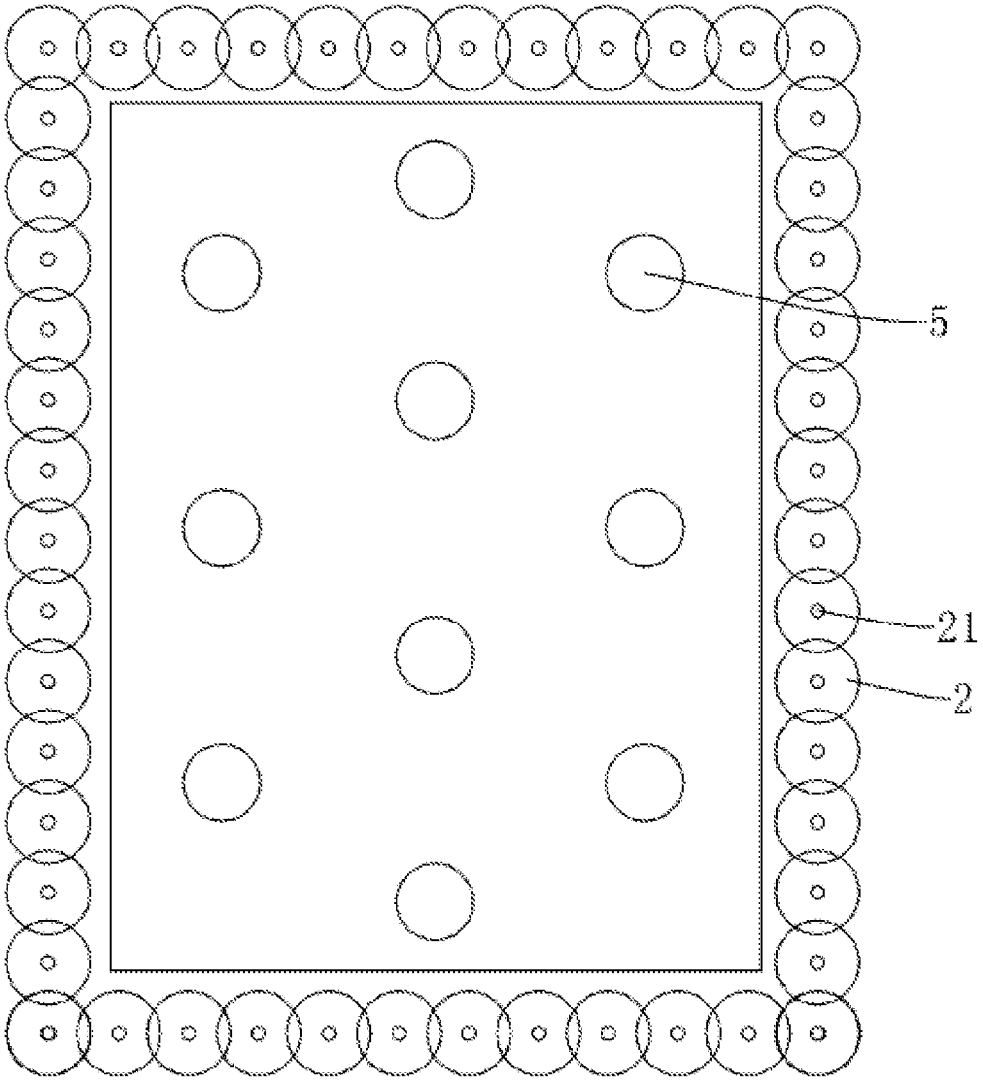
FIG. 3 is a plan sketch highlighting that the grouting ranges of the curtain holes mesh and overlap with each other in step 2.

Step 2. forming a curtain wall 2, as shown in FIG. 2 and FIG. 3, vertically drilling holes downward around the bridge pier cap 3 to form a plurality of curtain holes 21 at intervals, the bottoms of the curtain holes 21 go deep into 2-4 m positions below the bottom ends of the pile foundations 5; grouting the curtain holes 21, and the grouting ranges of the adjacent curtain holes 21 mesh and overlap with each other to form the enclosed curtain wall 2; and the top surface of the curtain wall 2 is higher than the bottom surface of the pile shoe body 1, and preferably, is flush with the top surface of the pile shoe body 1, and the inner side surface, close to the top end, of the curtain wall 2 abuts to the outer side surface of the pile shoe body 1, so that the curtain wall 2 and the pile shoe body 1 form an inverted groove structure. The curtain wall 2 can be constructed by adopting a jet grouting pile technology, and preferably, after the drilling and grouting integrated machine is used for drilling to the design depth, grouting is performed; after the grouting rates reaches a design value, a drill stem is retracted by 1-2 m; and after stopping, grouting is continuously performed until vertical and continuous pile bodies are formed.

Before drilling, geological drilling is performed on soil layers around the cap 3, and then the spacing of the curtain holes 21 and the grouting rate are designed according to the geological conditions of stratums near the pile bottoms. In general, the spacing between the curtain holes 21 is 2-3 m, and the interlocking part is greater than 50 cm. As long as the grouting pressure in the curtain holes 21 can meet the effective pile diameter requirements, the grouting pressure in the curtain holes 21 is determined according to the stratum conditions and the grouting depth.

It should be pointed out that there is no strict construction sequence for the step 1 and the step 2, the curtain wall 2 can be constructed first, and then the pile shoe body 1 is constructed. Downward drilling can be continuously performed at the original hole positions to form lifting holes 4 within 12-24 hours after the construction of the pile shoe body 1 is completed, and then pressure grouting is performed.

Figure 4:
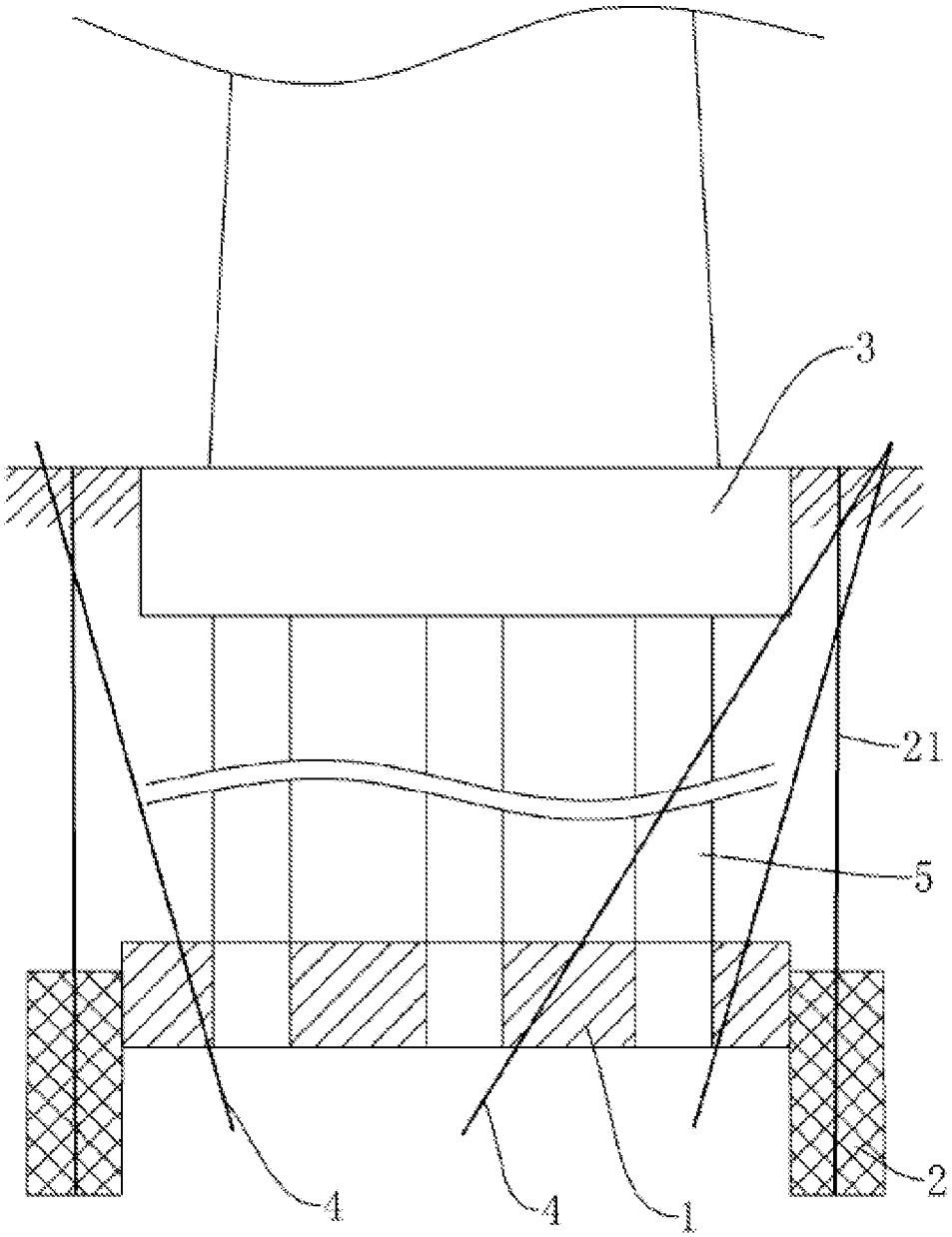
FIG. 4 is a schematic diagram of reinforcing, lifting and grouting in step 3.
Figure 5:
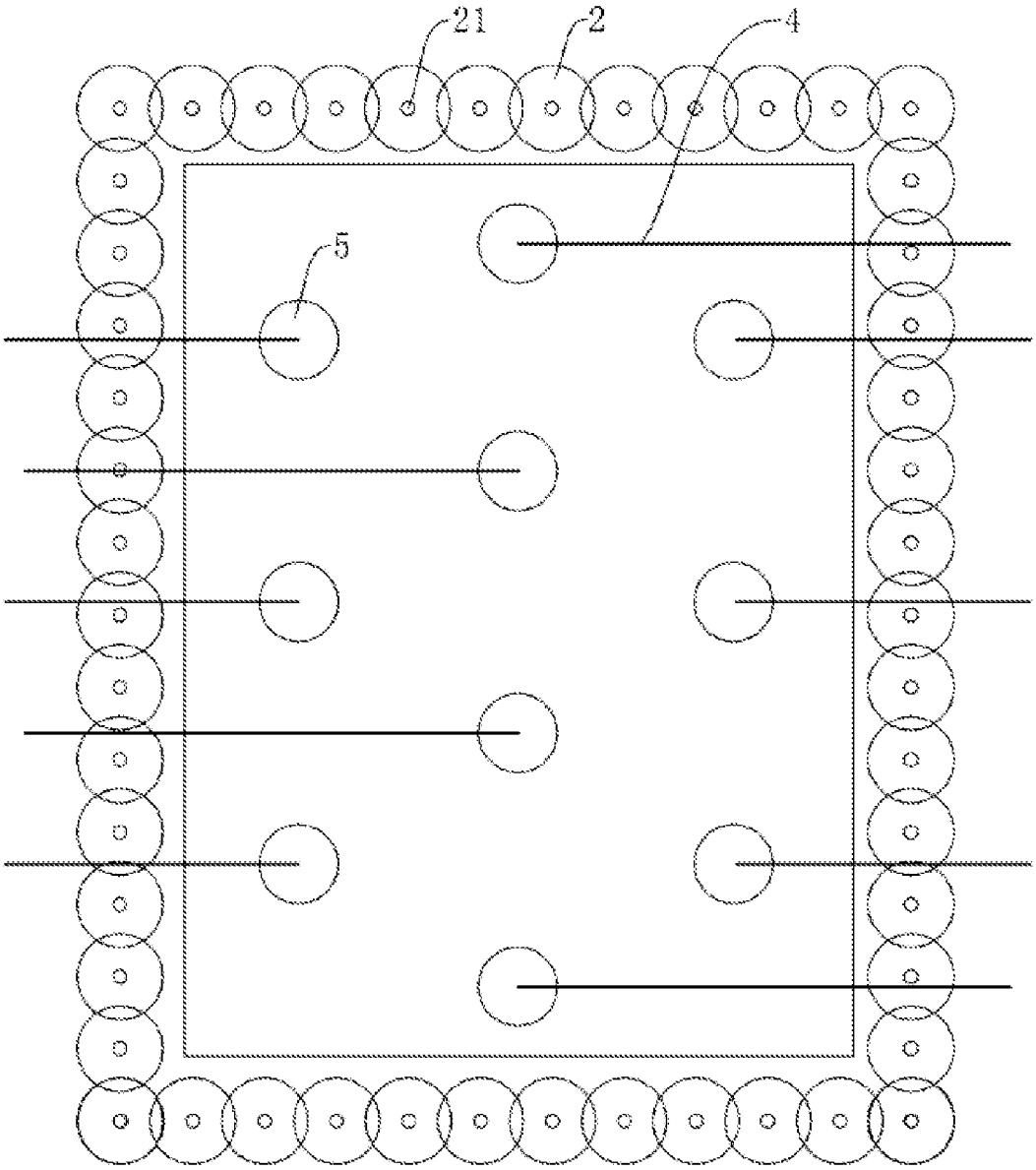
FIG. 5 is a schematic diagram of the plan layout of lifting holes in step 3.

Step 3: reinforcing and lifting, as shown in FIG. 4 and FIG. 5, obliquely drilling holes downward to form lifting holes 4, the lifting holes go deep into the bottoms of the pile foundations 5, pressure-grouting to the bottoms of the lifting holes 4, the injected grout is a rapid solidification grout, as the grout in the enclosed range of the curtain wall 2 increases and solidifies rapidly, the bridge pier is gradually lifted, and when the bridge pier is lifted to a preset height, the grouting stops.

During lifting and grouting, pressure grouting at the bottoms of all the pile foundations 5 is performed simultaneously, or part of the pile foundations 5 in symmetrical positions can be subjected to simultaneous grouting, and the grouting pressure in all the lifting holes 4 is kept consistent in the grouting process so as to ensure that the overall force of the cap 3 is balanced. The principle of grouting pressure setting is as follows: the reference pressure=the total gravity of the bridge pier, the cap 3, the pile foundations 5 and a top beam body, and the sum of the frictional resistance of all pile foundations 5/the bottom area of the cap 3, the grouting pressure should be greater than the reference pressure, and less than 1.8 times the reference pressure. The grouting pressure of the grouting holes 11 for the pile shoe body in the step 1, the reinforcing and grouting in step 4, filling and grouting holes 71 in step 5 and step 6 should be less than or equal to the reference pressure.

Step 4: reinforcing the soil body around the pile foundations 5 in order to avoid the secondary sedimentation of the bridge pier. Specifically, after lifting in the step 3 is completed, the grouting pipes are retracted upward to the upward side of the pile shoe body 1, and the soil body around the pile foundations 5 are grouted and reinforced to increase the side friction resistance of the pile foundations 5.

Figure 6:
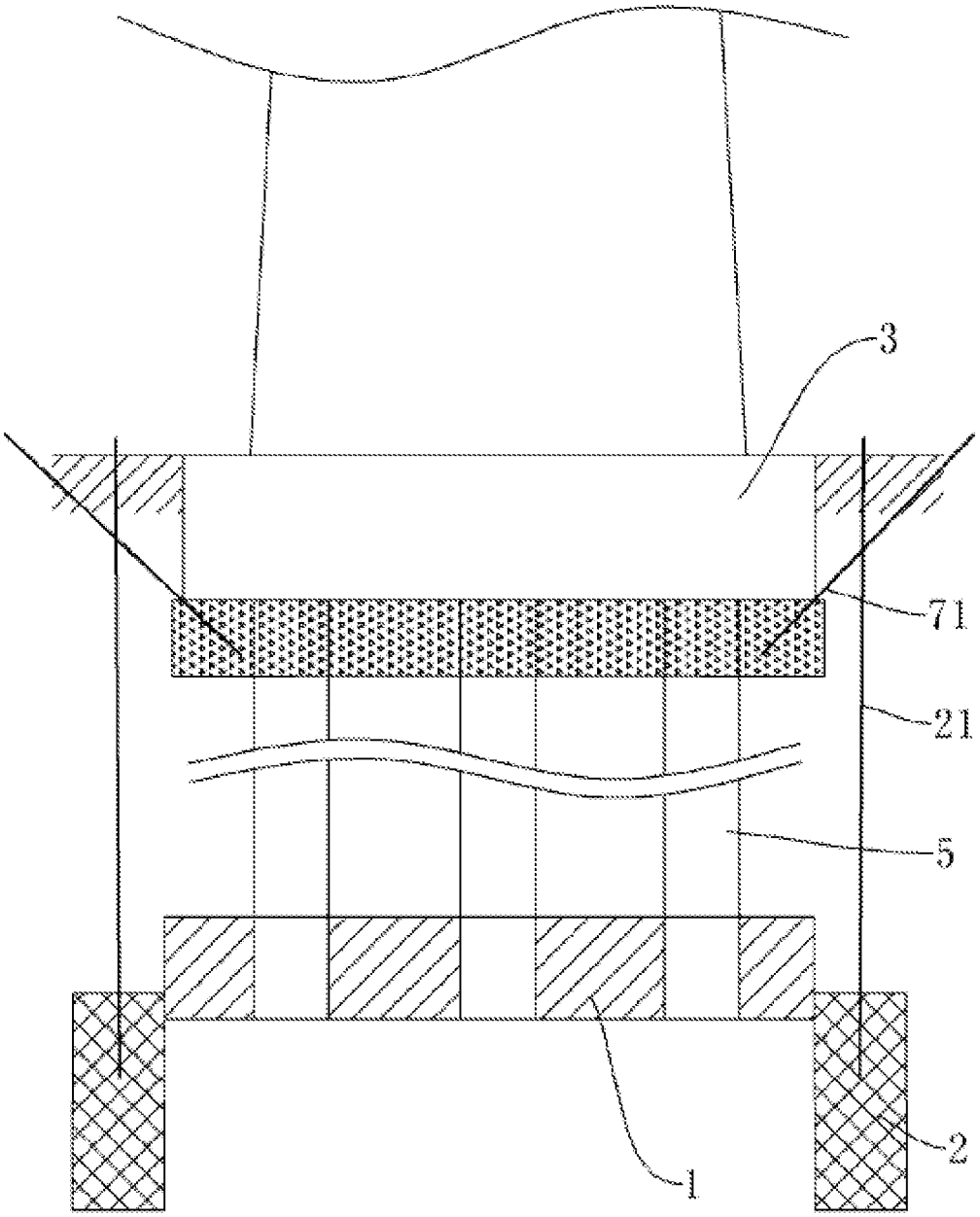
FIG. 6 is a schematic diagram of filling and grouting the bottom of a cap in step 5.

Step 5: as shown in FIG. 6, after the bridge pier is lifted, the bottom surface of the cap 3 is separated from the original soil at the bottom of the cap 3, therefore, the filling and grouting holes 71 are obliquely drilled from the ground to the bottom of the cap 3, and then the bottoms of the holes are grouted to fill the gaps at the bottom of the cap 3, so that the cap 3 can transmit force to the bottom soil body, and the bottom soil body and the pile foundations 5 bear the load from the bridge pier and the cap 3.

Figure 7:
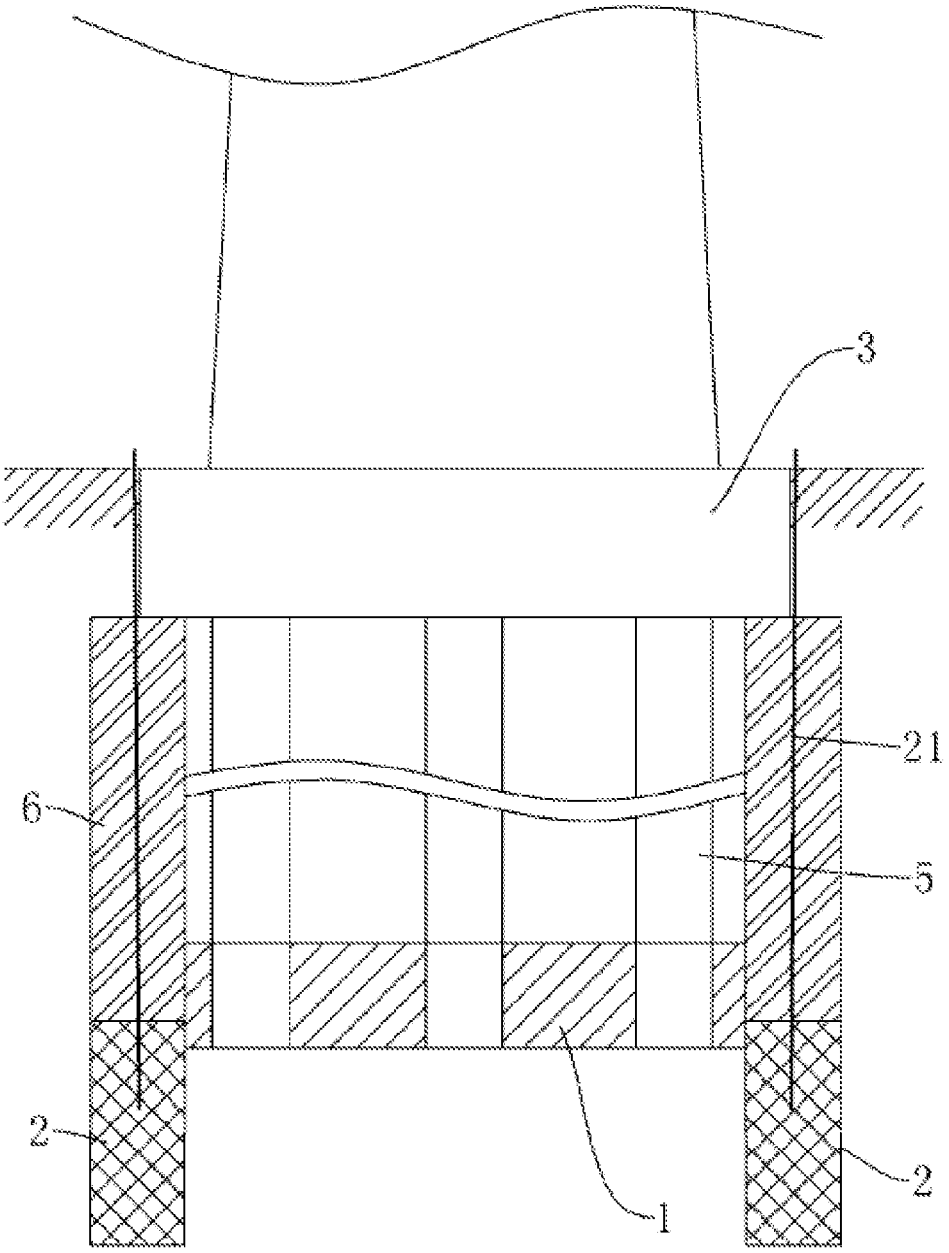
FIG. 7 is a schematic diagram of grouting reinforced pile foundations formed in step 6.

Step 6: as shown in FIG. 7, part or all of the curtain holes 21 are continuously grouted, and the grout is pressed into the soil body around the curtain holes 21 to form reinforced pile foundations 6, and the tops of the reinforced pile foundations 6 extend to positions close to the bottom of the cap 3. When the curtain holes 21 are clung to the side of the cap 3, half of the formed sections of the pile foundations 5 can be topped to the bottom surface of the cap 3, and the reinforced pile foundations 6 can support the cap 3, and bear the upper load with the pile foundations 5 of the original bridge pier.

Figure 8:
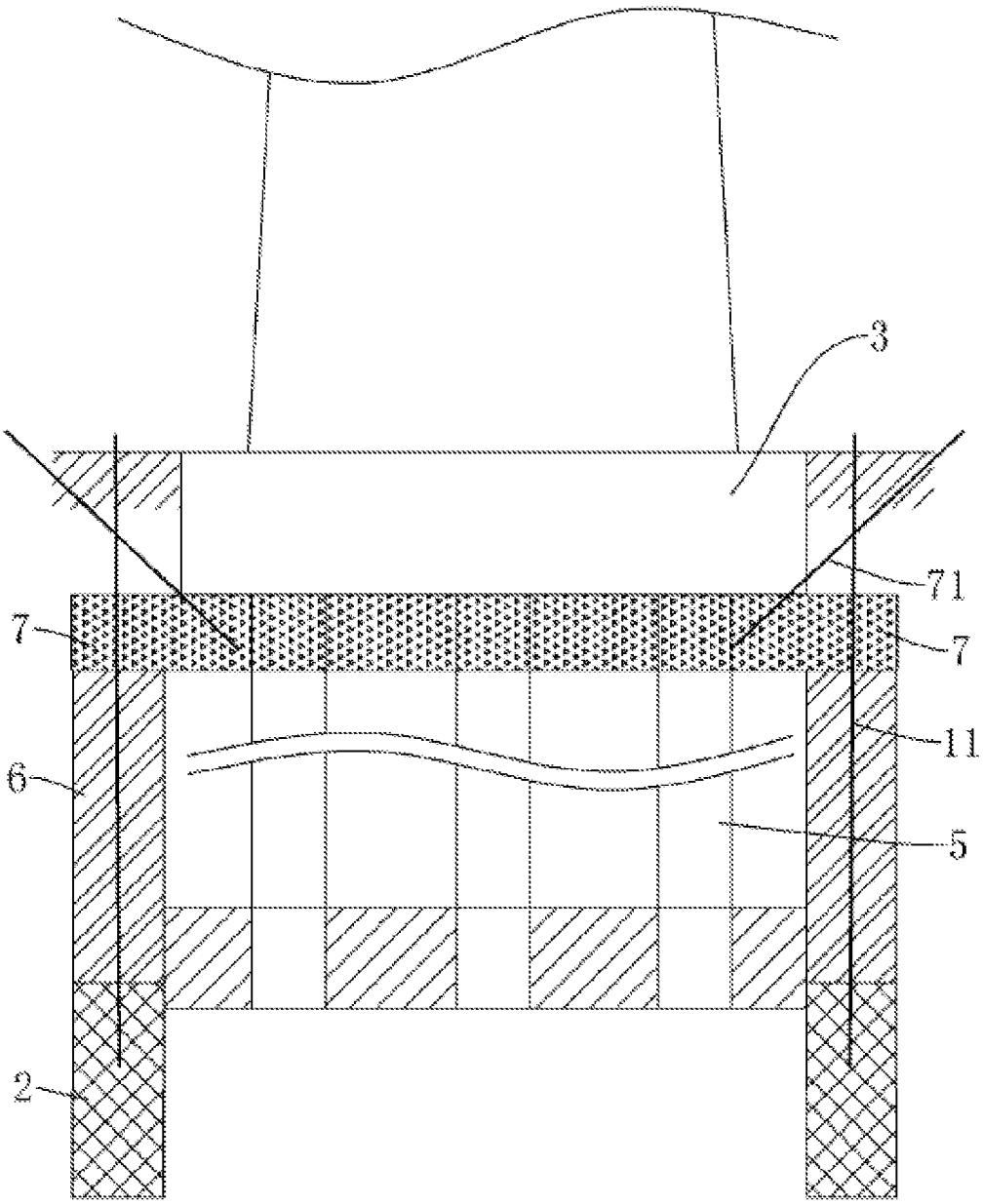
FIG. 8 is a schematic diagram of a reinforced body lapped on the reinforced pile foundations bearing fore together with the reinforced pile foundations.

Further, as shown in FIG. 8, pressure grouting is performed at the bottom of the cap 3 to form a reinforced body 7, and the reinforced body 7 extends out of the cap 3 and is lapped on the top surfaces of the reinforced pile foundations (6). Or after grouting and filling in the step 5 are completed, pressurized grouting is continuously performed in the filling and grouting holes 71 to expand a grouting body into the reinforced body 7. Filling and grouting in the step 5 and the grouting 5 for forming the reinforced body 7 in the step 5 can be performed after the reinforced pile foundations 6 are formed.

Figure 9:
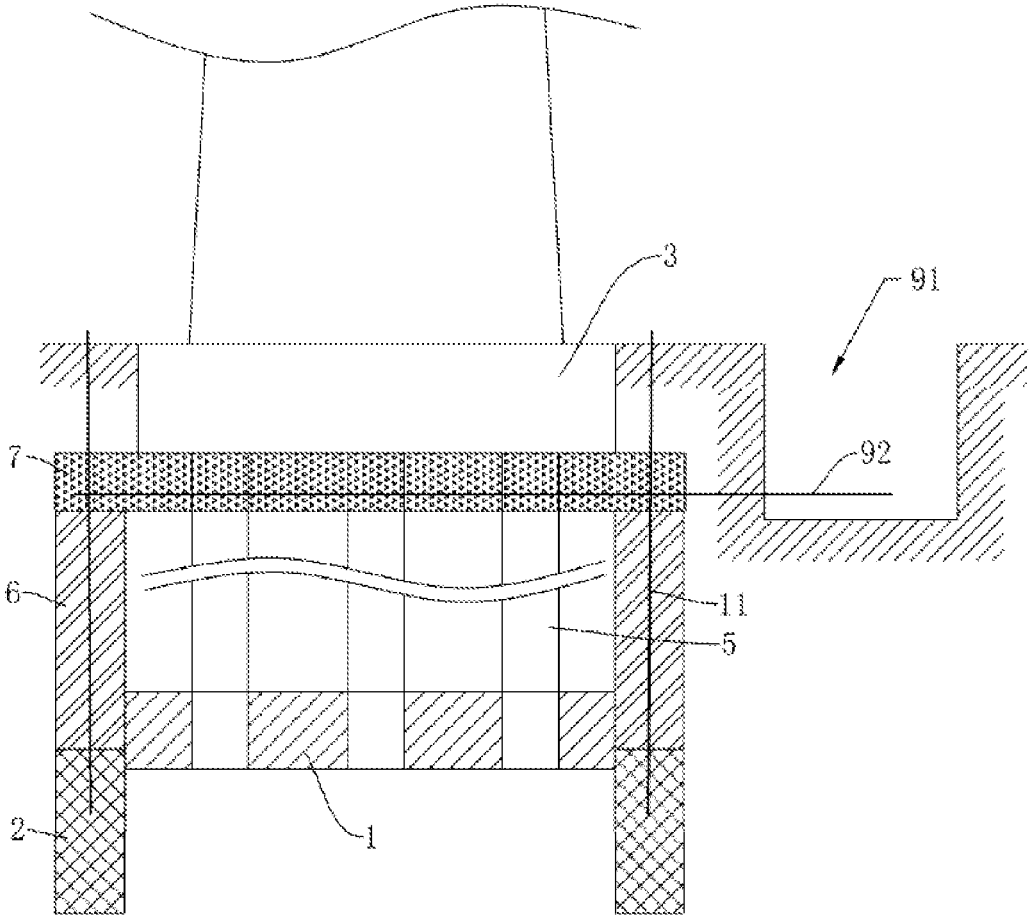
FIG. 9 is a schematic diagram of driving grouting holes horizontally to form the reinforced body and using the grouting pipes as the skeletons of the reinforced body

In order to form the whole reinforced body 7 at the bottom of the cap 3 for better transmitting the force to the reinforced pile foundations 6, as shown in FIG. 9, a working pit 91 is excavated beside the cap 3, the bottom of the working pit 91 is lower than the bottom of the cap 3, a plurality of horizontal grouting pipes 92 are horizontally driven into the bottom of the cap 3 in the working pit 91, grouting is performed, so that the whole reinforced body 7 is formed at the bottom of the cap 3, and at the same time, the gaps at the bottom of the cap 3 are filled. The whole reinforced body 7 is equivalent to the enlarged cap 3, after the whole reinforced body 7 is combined with the reinforced pile foundations 6, a new set of pile foundation 5-cap 3 structure is formed, and bears force together with the original pile foundations 5 and the cap 3 to avoid the secondary sedimentation of the bridge pier.

The horizontally driven grouting pipes 92 can adopt a technology of grouting through screen pipes, and the drilling and grouting integrated machine can also be adopted. After grouting, the grouting pipes 92 may not be pulled out and serve as the skeletons of the reinforced body 7, so that the reinforced body 7 has relatively good integrity and better transmits force to the reinforced pile foundations 6. Or reinforcing steel bars can be driven between the adjacent grouting pipes to serve as the skeletons of the reinforced body 7.

Further, when the pile foundations 5 are friction piles, the soil layers at the bottoms of the piles are not dense, and therefore, the bottoms of the grouting holes 11 for the pile shoe body go deep into positions below the bottom ends of the pile foundations 5 of the bridge pier; and after grouting, the soil body among the pile foundations 5 form the pile shoe body 1, and the gaps in the soil body below the bottom ends of the pile foundations 5 are filled and compacted. During lifting and grouting, the soil body among grout outlets of the grouting pipes and the bottoms of the piles has been filled and compacted, so that the lifting force can be transmitted to the bottom surfaces of the pile foundations 5 more rapidly.

In order to avoid the accelerated sedimentation of the bridge pier caused by the softening of the soil body at the bottom of the cap 3 and the soil body around the cap 3 in the entire construction process, all the above-mentioned grout for grouting is a rapid solidification grout. Preferably, after the grout is sprayed out from the orifices of the grouting pipes, the grout solidifies within 5-60 seconds. Further, the solidification time of the grout for pressure grouting during lifting is 5-30 s, and the solidification time of the grout for other grouting is 30-60 s. The grout for grouting can be single grout or double grout.

When the dual grout is used, different grout reaches the grout outlets through different channels of the double-layer grouting pipe, and is pressed into the soil body together after converging at the grout outlets, and a solidification reaction occurs.

When a relatively long reinforced grouting body in the direction of hole depth is to be formed in one grouting hole, for example, when the construction such as horizontal drilling and grouting for the curtain wall 2, the reinforced pile foundations 6 and the bottom of the cap 3 is performed, the drilling and grouting integrated machine can be used for grouting in multiple sections. Or the holes can be drilled to the designed hole depth at one time, the drill stem (that is, the grouting pipe) is retracted in multiple sections, and grouting is performed; or drilling and grouting can be performed in sequence in each section. The distance that the drill stem advances or retracts should be less than the spreading radius of the grout.

The double-grout mentioned above is named the grout A and the grout B respectively; the two types of grouts reach the grout outlets of the grouting pipe from different channels of the drill stem, and are pressed into the surrounding soil body at the grout outlets; and after the two types of grouts converge in the soil body, a chemical reaction occurs, and initial solidification is completed in a short time.

As long as the grout can meet the requirements of the initial solidification time and has relatively good permeability, the grout can be any one of existing grout. As long as the grout after rapid initial solidification is not liquid, but a solid with certain strength, the solidification of the grout mentioned above represents the initial solidification, and the main purpose is to prevent the liquid grout from softening the foundation of the bridge pier.

One of the following grout formulations is available: the grout A comprises the following raw materials in parts by weight: 70-90 parts by weight of metal oxide and/or metal hydroxide, 0.5-1.2 parts of composite retarder, 0.5-0.7 part of water reducing agent, 0.7-1.5 parts of acid-base buffer, 3-5 parts of composite stabilizer, and 0.5-1.5 parts of composite surfactant. The metal oxide can be a combination of any two of magnesium oxide, aluminum oxide, magnesium phosphate and the like; the composite retarder is urea and sodium tripolyphosphate; the water reducing agent is a polycarboxylic acid water reducing agent; the acid-base buffer is magnesium carbonate or potassium hydroxide; the composite stabilizer is at least two of hydroxymethyl cellulose, n-alkyl cetyl alcohol, starch ether and cellulose ether; and the composite surfactant is at least two of alkyl polyoxyethylene ether, benzylphenol polyoxyethylene ether and alkyl sulfonate. When two or more than two different materials are used in the above individual component, the individual component can be prepared by the same order of magnitude. The use of the two materials is mainly used for preventing one of the materials from becoming invalid, so that the effect of overall composite grout is relatively stable.

The grout B comprises the following raw materials in parts by weight: 30-40 parts of phosphate and 0.2-1 part of defoaming agent. The phosphate can be diammonium hydrogen phosphate or potassium dihydrogen phosphate; and the defoaming agent can be an organic silicone defoaming agent or a polyether defoaming agent.

The grout A and the grout B are respectively mixed with water in a weight ratio of 100:40-50 and are stirred to form two types of grouts, and the two types of grouts are pressed into the grouting pipes through different pipelines, converge and react at the grout outlets and solidify in the soil body.

The difference in the initial solidification time of the composite grout is mainly realized by adjusting the specific gravity of the composite retarder. Preferably, during pressure grouting in the lifting process, less water is added to increase the concentration of the grout, so that the surrounding soil body is better squeezed (for example, the weight ratio of the grout A to water and the grout B to water is 100:40); and when other grout is injected, more water is added, so that the concentration of the grout is relatively low (for example, the weight ratio of the grout A to water and the grout B to water is 100:50).

This specific embodiment is only an explanation of the present invention, and is not a limitation of the invention. After reading this specification, modifications to this embodiment without creative contribution can be made by those skilled in the art as needed, and but as long as the modifications are within the scope of the claims of the invention, the modifications are protected by patent law.

REFERENCE NUMERALS IN THE DRAWINGS

1. pile shoe body; 11. grouting hole for pile shoe body; 2. curtain wall; 21. curtain hole; 3. cap; 4. lifting hole; 5. pile foundation; 6. reinforced pile foundation; 7. reinforced body; 71. filling and grouting hole; 91. working pit; 92. horizontal grouting pipe.

What is claimed is:

1. A method for reinforcing and lifting piers of high-speed rail, comprising:

step 1, forming a pile shoe body: obliquely drilling holes downward around a bridge pier cap to form a plurality of pile shoe body grouting holes, wherein bottoms of the pile shoe body grouting holes go into side positions of pile foundations close to bottom ends of bridge pier pile foundations; grouting to the bottoms of the pile shoe body grouting holes, and reinforcing soil body between a plurality of pile foundations and on periphery of the pile foundations to form the pile shoe body;

grouting to form a curtain wall: vertically drilling holes downward around the bridge pier cap to form a plurality of curtain holes at intervals, wherein bottoms of the curtain holes go below bottom ends of the pile foundations; grouting to the curtain holes, wherein grouting ranges of adjacent curtain holes mesh and overlap with each other to form an enclosed curtain wall; a top surface of the curtain wall is higher than a bottom surface of the pile shoe body;

step 2, reinforcing and lifting: obliquely drilling holes downward to form lifting holes, wherein the lifting holes go into bottoms of the pile foundations; pressure-grouting to the bottoms of the lifting holes, wherein as grout in the enclosed range of the curtain wall increases and solidifies and as the grout between the pile shoe body and an interlayer of a bearing stratum of the pile bottom continuously increases and solidifies, the bridge pier is gradually lifted to a preset height;

continuously grouting to part or all of the curtain holes, such that the grout is pressed into the soil body around the curtain holes to form reinforced pile foundations, wherein tops of the reinforced pile foundations extend to positions close to the bottom of the cap; grouting to the bottom of the cap to form a reinforced body, wherein the reinforced body extends out of the cap and is lapped on the top surfaces of the reinforced pile foundations.

2. The method for reinforcing and lifting piers of high-speed rail according to claim 1, wherein, in the step 1, the bottoms of the pile shoe body grouting holes go below the bottom ends of the bridge pier pile foundations, and after grouting, gaps in soil body below the bottom ends of the pile foundations are filled.

3. The method for reinforcing and lifting piers of high-speed rail according to claim 1, after the step of reinforcing and lifting grouting, further comprising grouting to the bottom of the cap to fill gaps at the bottom of the cap.

4. The method for reinforcing and lifting piers of high-speed rail according to claim 1, wherein an inner side surface, close to the top end, of the curtain wall abuts to an outer side surface of the shoe pile body.

5. The method for reinforcing and lifting piers of high-speed rail according to claim 1, wherein the curtain wall and the reinforced pile foundations are constructed by a drilling and grouting integrated machine, and the grouting is performed sequentially in multiple sections in a vertical direction; after the grout is sprayed out from orifices of grouting pipes, the grout is pressed into surrounding soil body and solidifies within 30-60 s.

6. The method for reinforcing and lifting large scale piers of high-speed rail according to claim 1, further comprising: driving horizontally multiple horizontal grouting pipes to the bottom of the cap and grouting to form a whole reinforced body at the bottom of the cap, and fill gaps at the bottom of the cap.

7. The method for reinforcing and lifting piers of high-speed rail according to claim 1, wherein, during lifting and grouting, pressure grouting at the bottoms of all the pile foundations is performed at the same time.

8. The method for reinforcing and lifting piers of high-speed rail according to claim 1, wherein, lifting holes are constructed by adopting a drilling and grouting integrated machine, and after the grout is sprayed out from orifices of grouting pipes, the grout is pressed into surrounding soil body and solidifies within 5-30 s.

9. A reinforcing and lifting structure for piers of high-speed rail, wherein the reinforcing and lifting structure is formed by the method for reinforcing and lifting piers of high-speed rail of claim 1.

* * * * *